US005378180A

United States Patent [19]

Nakayama et al.

[11] Patent Number: 5,378,180

[45] Date of Patent: Jan. 3, 1995

[54] EXHAUST SYSTEM FOR OUTBOARD MOTOR

[75] Inventors: Manabu Nakayama; Kouji Abe; Masafumi Sohgawa; Atsushi Isogawa, all of Hamamatsu, Japan

[73] Assignee: Sanshin Kogyo Kabushiki Kaisha, Hamamatsu, Japan

[21] Appl. No.: 157,706

[22] Filed: Nov. 24, 1993

[30] Foreign Application Priority Data

Nov. 26, 1992 [JP] Japan ..... 4-339869

[51] Int. Cl.[6] ..... F01N 3/28

[52] U.S. Cl. ..... 440/89

[58] Field of Search ..... 440/89, 900; 60/302, 60/298, 299, 310

[56] References Cited

U.S. PATENT DOCUMENTS

| | | | |
|---|---|---|---|
| 3,644,098 | 2/1972 | De Palma et al. | 23/288 |
| 4,023,361 | 5/1977 | Kojima | 60/302 |
| 4,354,847 | 10/1982 | Blanchard | 440/900 |
| 4,372,111 | 8/1983 | Virk et al. | 60/274 |
| 4,735,046 | 4/1988 | Iwai | 60/295 |
| 5,203,167 | 4/1993 | Lassanske et al. | 440/89 |

FOREIGN PATENT DOCUMENTS

| | | | |
|---|---|---|---|
| 3018277 | 5/1980 | Germany . | |
| 52-8932 | 3/1977 | Japan . | |
| 55-10043 | 1/1980 | Japan . | |
| 55-12233 | 1/1980 | Japan . | |
| 57-203814 | 12/1982 | Japan . | |
| 4039195 | 2/1992 | Japan | 440/89 |

*Primary Examiner*—Edwin L. Swinehart

*Attorney, Agent, or Firm*—Knobbe, Martens, Olson & Bear

[57] ABSTRACT

Two embodiments of outboard motors embodying tuned exhaust systems having exhaust pipes and expansion chambers into which the exhaust pipes extend. A catalyst is positioned in the exhaust system downstream of the point where the exhaust pipe terminates in the expansion chamber so as to preclude interference with the exhaust tuning. The catalyst bed is removable for ease of servicing without necessitating removal of the outboard motor from the its attachment to the associated watercraft and a trap device is provided for precluding water from entering the engine through its exhaust ports.

20 Claims, 2 Drawing Sheets

EXHAUST SYSTEM FOR OUTBOARD MOTOR

BACKGROUND OF THE INVENTION

This invention relates to an exhaust system for an outboard motor, and more particularly to an improved exhaust system for an outboard motor embodying a catalyst for treating the exhaust gases.

It is well-known that outboard motors demand very compact construction. This presents a number of design challenges, particularly in designing an effective exhaust system. The exhaust system should be designed in such a way so as to provide good silencing and also good engine performance. In addition, the exhaust system must be quite compact because of the very nature of an outboard motor.

The engine performance and/or silencing can be improved by providing an exhaust pipe which delivers the exhaust gases from the exhaust port of the engine into an expansion chamber. By appropriately choosing the length of the exhaust pipe and the volume of the expansion chamber, either or both of silencing and improved engine performance can be obtained.

There is, however, also an advantage in employing catalytic treatment for the exhaust gases of outboard motors. In addition to purifying the air into which the exhaust gases pass, the catalyst can be utilized to treat the exhaust gases to remove certain harmful constituents before they are released along with the exhaust gases into the body of water in which the watercraft is operating. It is well-known in marine applications to discharge the exhaust gases from the engine into the atmosphere through the body of water in which the watercraft is operating. In this way, the body of water aids in the silencing.

However, if a catalyst is placed in the exhaust system, and particularly in the exhaust pipe, then the presence of the catalyst bed can affect both the engine performance and the performance of the silencing system.

It is, therefore, a principal object of this invention to provide an improved exhaust system for an outboard motor that will permit exhaust tuning and, at the same time, accommodate a catalyst without interfering with that tuning.

It is a further object of this invention to province an exhaust system for an outboard motor employing an expansion chamber, an exhaust pipe and a catalyst that is positioned downstream of the point where the exhaust pipe discharges into the expansion chamber.

It is also desirable with outboard motors employing catalysts to dispose the catalyst bed in such a way that it can be removed for servicing. With many of the types of construction previously proposed, however, the catalyst has been positioned in a location where it is difficult to service it.

It is, therefore, a still further object of this invention to provide an improved outboard motor having a catalyst in its exhaust system wherein the catalyst is readily accessible for servicing.

There is a particular type of outboard motor mounting system employed for certain types of watercraft that employs a transom bracket that is affixed to the transom of the watercraft and which is pivotable about a horizontally disposed axis. The outboard motor is mounted for steering movement about a vertically extending axis at the lower end of this transom bracket, and at least a major portion of the power head is disposed below the tilt pivot axis. With this type of arrangement, it is very difficult to service the outboard motor, and particularly any catalytic exhaust system for it.

It is, therefore, a still further object of this invention to provide an improved catalytic exhaust system for an outboard motor that is mounted below the transom of a watercraft and wherein the catalyst is positioned at an area in the power head where it may be conveniently serviced without requiring tilting up or removal of the outboard motor from the watercraft hull.

SUMMARY OF THE INVENTION

A first feature of this invention is adapted to be embodied in an outboard motor that is comprised of a power head having an internal combustion engine with at least one exhaust port and a surrounding protective cowling. A drive shaft housing and lower unit depend from the power head and have a propulsion device driven by the engine for propelling the associated watercraft. Means are provided for affixing the outboard motor to an associated watercraft. An underwater exhaust gas discharge is provided for discharging exhaust gases to the atmosphere through the body of water in which the watercraft is operating. Exhaust conduit means convey exhaust gases from the exhaust port to the underwater exhaust gas discharge. This exhaust conduit means comprises an exhaust pipe extending from the exhaust port and an expansion chamber in which the exhaust pipe terminates. A catalyst is disposed in the exhaust conduit means downstream of the point where the exhaust pipe terminates in the expansion chamber.

Another feature of the invention is adapted to be embodied in an outboard motor comprised of a power head having an internal combustion engine with at least one exhaust port and a surrounding protective cowling. A drive shaft housing and lower unit depend from the power head and have a propulsion device driven by the engine for propelling an associated watercraft. Means, including a bracket defining a horizontal tilt pivot axis, is provided for attaching the outboard motor to a transom of an associated watercraft. When so attached, at least a substantial portion of the power head is disposed below the tilt axis. An underwater exhaust gas discharge is provided for discharging the exhaust gases from the engine to the atmosphere through the body of water in which the watercraft is operating. Exhaust conduit means convey the exhaust gases from the exhaust port to the underwater exhaust gas discharge. A catalyst bed is detachably positioned within the exhaust conduit means and is located within the power head and is accessible by removal of the protective cowling for servicing without necessitating removal of the outboard motor from the watercraft.

DETAILED DESCRIPTION OF THE PREFERRED EMBODIMENTS OF THE INVENTION

Figure 1:
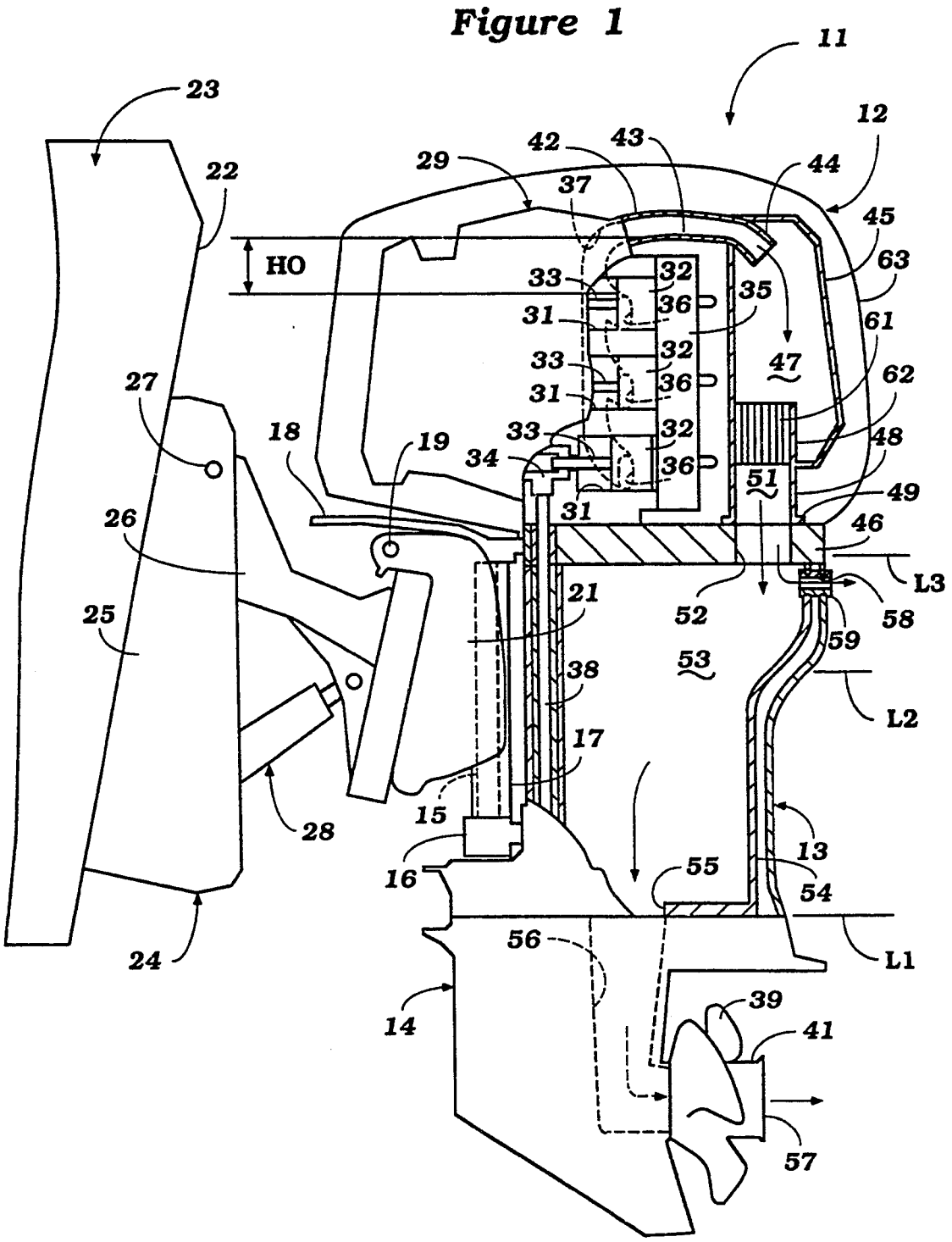
FIG. 1 is a partial side elevational view of a watercraft and attached outboard motor constructed in accordance with a first embodiment of the invention, with a portion of the outboard motor broken away and shown in section.

Referring now in detail to the drawings and initially to FIG. 1, an outboard motor constructed in accordance with a first embodiment of the invention is identified generally by the reference numeral 11. The outboard motor 11 includes a power head, indicated generally by the reference numeral 12; a drive shaft housing, indicated generally by the reference numeral 13, which depends from the power head 12; and a lower unit, indicated generally by the reference numeral 14, positioned at the lower end of the drive shaft housing. The outboard motor 11 further includes a steering shaft 15 that is affixed to the drive shaft housing 13 by means of a lower bracket 16 and an upper bracket (not shown). This steering shaft 15 is supported for pivotal movement about a vertically extending steering axis within a swivel bracket 17. A tiller 18 is affixed to the upper end of the steering shaft 15 for steering of the outboard motor 11 in a well-known manner.

The swivel bracket 17 is pivotally connected by means a pivot pin 19 to a clamping bracket 21. Normally, the clamping bracket 21 will be affixed directly to a transom an associated watercraft, and the pivot axis defined by the pivot pin 19 is employed for tilt and trim operation of the outboard motor.

In accordance with a feature of the invention, however, the outboard motor 11 is adapted to be mounted on a transom 22 of an associated watercraft, shown partially and indicated generally by the reference numeral 23, by a tilt bracket assembly, indicated generally by the reference numeral 24 The tilt bracket assembly 24 permits the outboard motor 11 to be mounted very low on the transom 22, as is desirable with certain types of watercraft. The bracket assembly 24 is comprised of a transom plate 25 that is affixed in a suitable manner to the transom 22 and which carries a tilt bracket 26 for pivotal movement by means of a pivot pin 27. A hydraulic cylinder assembly, indicated generally by the reference numeral 28, is provided for power tilt and trim adjustment and may also include a shock absorbing function, as is well-known in this art. It should be noted that a substantial portion of the power head 12 lies below the pivot axis defined by the pivot pin 27, and the entire outboard motor 11 is normally disposed below the upper end of the transom 22.

Referring now again in detail to the construction of the outboard motor 11, the power head 12 includes an internal combustion engine, indicated generally by the reference numeral 29. Although the invention is capable of use with a wide variety of types of engines, in the illustrated embodiment, the engine 29 is depicted as being of the V6 type. In the figure, three vertically spaced cylinder bores 31 of a cylinder block assembly are depicted, and pistons 32 are supported for reciprocation within the cylinder bores 31. These pistons 32 are connected by means of connecting rods 33 in a well-known manner to the throws of a crankshaft 34. As is typical with outboard motor practice, the crankshaft 34 is supported for rotation about a generally vertically extending axis in a well-known manner.

Although it does not appear in the drawings, the engine 29 is provided with an induction and charge-forming system that emits a charge to the crankcase chambers of the engine for compression by the pistons and then transfer to combustion chambers formed above the heads of the pistons 30 32 by the pistons 32, cylinder bores 31, and cylinder heads 35 that are affixed to each bank of cylinders. Since the invention deals primarily with the exhaust system of the engine, it is not believed necessary to describe other components of the engine or any further details of the engine except for the exhaust system. It will be understood that the invention may be employed with any known type of engine.

The cylinder bores 31 are formed with exhaust ports 36, which receive the exhaust gases from the combustion chambers and deliver them to an exhaust manifold 37, which is formed either wholly or partially within the cylinder block assembly of the engine. It will be understood that there is one exhaust manifold 37 for each bank of cylinders.

The crankshaft 34 is connected by means of a spline connection to a drive shaft 38, which is suitably journalled within the drive shaft housing 13 and which depends into the lower unit 14. A conventional forward, neutral, reverse transmission (not shown) is provided in the lower unit 14 for driving a propeller 39 having a hub 41 in selected forward and reverse directions.

The construction of the outboard motor 11 as thus far described may be considered to be conventional, and for that reason any components that have not been illustrated or described may take any conventional form. However, unlike most conventional outboard motor constructions, the exhaust manifold 37, rather than extending downwardly toward the drive shaft housing 13 and lower unit 14, extends upwardly and cooperates with respective exhaust pipes 42, which have an elongated horizontally extending portion 43, the lower end of which is above the upper peripheral edge of the uppermost exhaust port 36 for each exhaust bank. The exhaust pipes 42 then terminate in downwardly extending sections 44 so as to form a trap-like construction that will preclude any water that may enter the exhaust system from being drawn into the engine through the exhaust ports 36.

The exhaust pipes 44 terminate within a housing assembly 45 that is mounted in the power head 12 on the upper side of a spacer plate 46 that is disposed between the engine 29 and the drive shaft housing 13. This housing 45 defines an internal volume 47, which functions as an expansion chamber and is tuned in capacity along with a tuning of the length of the exhaust pipes 42 so as to provide either exhaust tuning for improving engine power or exhaust tuning for improved silencing or both.

At the lower end of the expansion chamber, the housing 45 is provided with a neck portion 48 having a flange 49 at its lower end for detachable mounting on the spacer plate 46.

An exhaust discharge passage 51 is formed by this neck section 48, which communicates with an exhaust discharge passage 52 formed in the spacer plate 46. Thus, exhaust gases flow from the exhaust pipes 42 into the expansion chamber 47 through the neck 51 and opening 52 into a further expansion chamber 53 formed in the drive shaft housing 13 by an inner shell 54.

The lower end of the drive shaft housing expansion chamber 53 forms a discharge opening 55 that communicates with an exhaust passageway 56 formed in the lower unit and which terminates in an underwater exhaust gas discharge. In the illustrated embodiment, this discharge is a through-the-hub discharge, indicated at 57.

When operating at high speeds and the associated watercraft 23 is planing, the water level will be as shown by the line L1, and, although the through-the-hub exhaust gas discharge 57 is fully submerged, the pressure of the exhaust gases will be sufficient to exit through this opening so that the body of water provides additional silencing for the exhaust gases. However, when the watercraft 23 is stationary, idling or traveling at low speed, the underwater exhaust gas discharge 57 will be too deeply submerged for the exhaust gases to exit the underwater exhaust gas discharge 57, and the exhaust pressure will be too low for the exhaust gases to exit in this way. Therefore, there is provided a further above-the-water exhaust gas discharge 58 formed by an insert tube 59 that extends from the expansion chamber forming member 54 through the drive shaft housing 13 to the atmosphere for discharge of exhaust gases in this restricted path. This will be the exit for all the exhaust gases when idling or operating at low speeds. However, as the speed of the watercraft increases, and the water level drops from the line L2 to the line L1, only minimal exhaust gas will discharge through this opening 58, as is well-known in this art.

The water level may even reach a higher level at the line L3 when the watercraft 23 is abruptly decelerated, and hence the water level in the expansion chamber 53 may rise even above the line L2 under this condition. As is well-known, the exhaust gases of an engine at times have negative pressure in the exhaust system. However, since the exhaust pipes 42 are positioned high in the power head and are formed in a trap-like fashion, any likelihood of water entering the engine through the exhaust ports 36 is totally eliminated.

In accordance with a feature of the invention, a catalyst bed 61 formed from any suitable material and has an outer shell that is slip-fit into a neck portion 62 that extends upwardly into the expansion chamber 47 from its lower neck portion 48. Thus, the exhaust gases will be treated quite close to the exhaust gas discharge, but the catalyst bed 61 will not interfere with the tuning of the exhaust system using the exhaust pipes 42 and the expansion chamber 47. Also, since the catalyst bed 61 is positioned in the power head 12, it may be easily serviced by removing the protective cowling 63 that encircles the engine 29 and completes the power head 12. Also, although the outboard motor 11 is mounted low relative to the transom 22, the catalyst bed 61 may be easily accessed without having to remove the outboard motor 11 from the transom 22, or even to tilt it up, for that matter.

Figure 2:
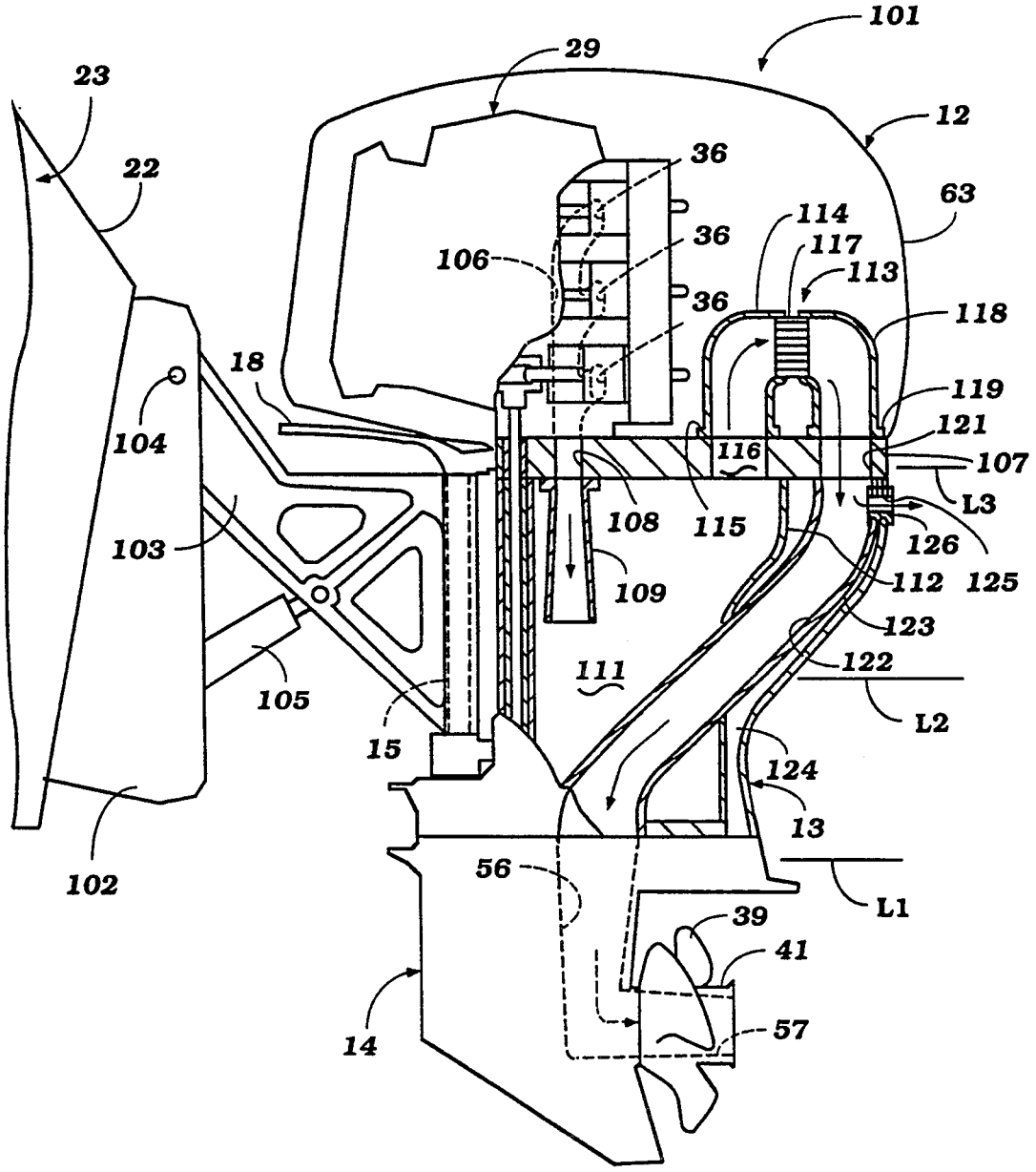
FIG. 2 is a side elevational view, in part similar to FIG. 1, and shows another embodiment of the invention.

An outboard motor constructed in accordance with another embodiment of the invention is shown in FIG. 2 and is identified generally by the reference numeral 101. Unlike the outboard motor 11 of the embodiment of FIG. 1, the outboard motor 101 of this embodiment is of the type designed to be attached at a low position on the transom of the associated watercraft rather than requiring the intermediate supporting bracket 24 of the previous embodiment. Except for this feature and certain details of the exhaust system, the embodiment of this figure is substantially the same as that of the previously described embodiment, and where that is the case, components that are the same or substantially the same have been identified by the same reference numerals. These similar components include the basic construction of the engine 29 and the basic construction of the outboard motor 101, except for its exhaust system, as will become apparent.

In this embodiment, there is provided a transom bracket 102 which is affixed to the transom 22 of the watercraft 23 in a manner similar to that of a previously described embodiment. In this embodiment, however, a swivel bracket 103 is pivotably connected to the transom bracket 102 by means of a pivot pin 104 for tilt and trim operation. A hydraulic cylinder 105 is interposed between the tilting bracket 103 and the transom plate 102 for the tilt and trim operation. The steering shaft 15 is supported for steering movement in the bracket 103.

In this embodiment, the exhaust ports 36 of each cylinder bank of the engine 29 discharge into an exhaust manifold 106 which may also be formed integrally within the cylinder block but which extends downwardly toward a spacer plate 107 on which the engine 29 is mounted at the upper end of the drive shaft housing 13. These exhaust manifolds 106 terminate at a pair of openings 108 formed in the spacer plate so that exhaust gases can flow downwardly into a pair of exhaust pipes 109 that are fixed to the underside of the spacer plate 107. These exhaust pipes 109 terminate, as is typical in conventional outboard motor practice in an expansion chamber 111 formed by an inner shell 112 contained within the drive shaft housing 13. It will be noted that the exhaust pipes 109 terminate only slightly above the idle or low speed of water line L2 and hence, in conventional constructions, there is a danger that negative exhaust pulses can cause water to be drawn back into the engine through the exhaust ports 36 under these conditions.

This condition is avoided in this embodiment, by a trap like section, indicated generally by the reference numeral 113 that is provided in the power head 12 within the protective cowling 63 and above the spacer plate 107. This trap section 113 includes a first elbow 114 having a flange 115 at its lower end that is detachably affixed to the upper side of the spacer plate 107 and which communicates with an exhaust gas passage 116 formed in the spacer plate. The outer shell of a catalyst bed 117 is slipped into the upper end of the elbow 114.

A further elbow 118 is slipped over the other end of the catalyst bed 117 and has a flange 119 at its lower end which is detachably connected to the upper side of the spacer plate 107. This elbow 118 communicates with an opening 121 formed in the spacer plate 104 and which communicates with an exhaust gas conduit 122 formed by a pipe 123 contained within the drive shaft housing 13. This pipe extends at an upper end through a recess 124 formed between the inner shell 112 and the drive shaft housing 13. However, the lower end of the pipe 123 passes through the wall of the inner shell 112 and extends partially downwardly through the expansion chamber 111 so as to deliver the exhaust gases to the lower unit exhaust gas conduit 56.

An above the water exhaust gas discharge 125 is formed by a pipe section 126 that extends between the upper end of the pipe 123 and the outer periphery of the drive shaft housing 13 for the low speed above the water exhaust gas discharge.

With this construction, it should be readily apparent that any water which may enter the exhaust system when the watercraft is operating slowly or is being abruptly decelerated will only flow into the pipe passage 122 and will be prevented by the trap section 113 from reaching the exhaust pipe 109 or entering the engine through its exhaust port 36. Also, like the previously described embodiment, even though the upper end of the power head 12 is disposed below the upper portion of the transom 22, the catalyst bed 117 can be easily accessed by removing the protective cowling 63 and one of the elbows 114 and 118. Hence, this embodiment has the same advantages as the previously described embodiment. Also, the catalyst bed 117 is disposed downstream of the expansion chamber 111 and hence, it will not adversely affect the exhaust tuning for either silencing and/or power purposes.

It is to be understood that the foregoing description is that of two preferred embodiments of the invention but the various changes and modifications may be made without departing from the spirit and scope of the invention, as defined by the appended claims.

We claim:

1. An outboard motor comprise of a power head having an internal combustion engine with at least exhaust port and a surrounding protective cowling, a drive shaft housing and lower unit depending from said power head and having a propulsion device driven by said engine for propelling an associated watercraft, means for attaching said outboard motor to an associated watercraft, an underwater exhaust gas discharge for discharging exhaust gases to the atmosphere through the body of water in which the watercraft is operating, and conduit means for conveying exhaust gases form said exhaust port to said underwater exhaust gas discharge, said exhaust conduit means comprising an exhaust pipe extending from said exhaust port, an expansion chamber into which said exhaust pipe terminates, and a catalyst bed disposed in a portion of said exhaust conduit means in said power head surrounded by said protective housing and downstream of the position where said exhaust pipe terminates in said expansion chamber.

2. An outboard motor of claim 1, wherein the catalyst bed is removable.

3. An outboard motor of claim 2, wherein the catalyst bed is accessible through removal of the protective cowling.

4. An outboard motor of claim 3, wherein the catalyst bed is disposed in the expansion chamber.

5. An outboard motor of claim 3, wherein the catalyst bed is disposed downstream of the expansion chamber in the exhaust conduit means.

6. An outboard motor comprised of a power head having an internal combustion engine with at least exhaust port and a surrounding protective cowling, a drive shaft housing and lower unit depending from said power head and having a propulsion device driven by said engine for propelling an associated watercraft, means for attaching said outboard motor to an associated watercraft, an underwater exhaust gas discharge for discharging exhaust gases to the atmosphere through the body of water in which the watercraft is operating, and conduit means for conveying exhaust gases from said exhaust port to said underwater exhaust gas discharge, said exhaust conduit means comprising an exhaust pipe extending from said exhaust port, an expansion chamber positioned within said power head into which said exhaust pipe terminates, and a catalyst bed disposed in said exhaust conduit means downstream of the position where said exhaust pipe terminates in said expansion chamber.

7. An outboard motor of claim 6, wherein the catalyst bed is disposed within the expansion chamber.

8. An outboard motor of claim 7, wherein the exhaust conduit means comprises a further expansion chamber positioned within the drive shaft housing and lower unit.

9. An outboard motor of claim 8, wherein the catalyst bed is removable.

10. An outboard motor of claim 9, wherein the means for attaching the outboard motor to a transom of the associated watercraft includes means defining a horizontally disposed tilt axis about which the outboard motor may be tilted and trimmed, and a substantial portion of the power head is disposed below this tilt axis.

11. An outboard motor of claim 10, wherein the top of the power head is disposed below the transom of the associated watercraft to which it is affixed.

12. An outboard motor comprised of a power head having an internal combustion engine with at least exhaust port and a surrounding protective cowling, a drive shaft housing and lower unit depending from said power head and having a propulsion device driven by said engine for propelling an associated watercraft, means for attaching said outboard motor to an associated watercraft, an underwater exhaust gas discharge for discharging exhaust gases to the atmosphere through the body of water in which the watercraft is operating, and conduit means for conveying exhaust gases from said exhaust port to said underwater exhaust gas discharge, said exhaust conduit means comprising an exhaust pipe extending from said exhaust port, an expansion chamber formed in said drive shaft housing and lower unit and into which said exhaust pipe terminates, and a catalyst bed disposed in said exhaust conduit means downstream of the position where said exhaust pipe terminates in said expansion chamber, said exhaust conduit means comprises a trap section having a downwardly extending section, an Upwardly extending section and a horizontally extending section joining said upwardly extending section and said downwardly extending section and disposed entirely within said power head and downstream of said expansion chamber for precluding water from entering the exhaust port form the underwater exhaust gas discharge.

13. An outboard motor of claim 12, wherein the catalyst bed is removable.

14. An outboard motor of claim 12, wherein the catalyst bed is disposed in the trap section.

15. An outboard motor of claim 14, wherein the catalyst bed is removable.

16. An outboard motor of claim 15, wherein the means for attaching the outboard motor to a transom of the associated watercraft includes means defining a horizontally disposed tilt axis about which the outboard motor may be tilted and trimmed, and a substantial portion of the power head is disposed below this tilt axis.

17. An outboard motor of claim 16, wherein the top of the power head is disposed below the transom of the associated watercraft to which it is affixed.

18. An outboard motor comprised of a power head having an internal combustion engine with at least one exhaust power and a surrounding protective cowling, a drive shaft housing and lower unit depending from said power head and having a propulsion device driven by said engine for propelling an associated watercraft, bracket means supporting said outboard motor for steering movement about a vertically extending steering axis, and providing a pivotal connection at one end thereof for attachment to the transom of an associated watercraft for tilt and trim movement of the outboard motor about a horizontal tilt axis relative to the associated watercraft, said horizontal tilt axis being disposed above a substantial portion of said power head when said outboard motor is attached to the associated watercraft, an underwater exhaust gas discharge for discharging exhaust gases to the atmosphere through a body of water in which the watercraft is operating, and exhaust conduit means for conveying exhaust gases from said exhaust port to said underwater exhaust gas discharge, and a removable catalyst bed positioned in a portion of said exhaust conduit means to the rear of said power head relative to said horizontal tilt axis and to the rear of said engine for treating the exhaust gases and for replacement of the catalyst bed through removal of the protective cowling without necessitating the detachment of the outboard motor from the associated watercraft.

19. An outboard motor of claim 18, wherein the catalyst bed is provided within a trap section formed in the power head to the rear thereof from the horizontal tilt axis and of the engine for precluding water from the drive shaft housing and lower unit from entering the engine through the exhaust port.

20. An outboard motor of claim 18, wherein the exhaust conduit means comprises an expansion chamber in the power head in which the removable catalyst bed is positioned.

* * * * *